US010612212B2

(12) United States Patent
Kondo et al.

(10) Patent No.: US 10,612,212 B2
(45) Date of Patent: Apr. 7, 2020

(54) HYDRAULIC EXCAVATOR DRIVE SYSTEM

(71) Applicant: KAWASAKI JUKOGYO KABUSHIKI KAISHA, Kobe-shi, Hyogo (JP)

(72) Inventors: Akihiro Kondo, Kobe (JP); Takehisa Kato, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 119 days.

(21) Appl. No.: 15/711,497

(22) Filed: Sep. 21, 2017

(65) Prior Publication Data

US 2018/0080196 A1 Mar. 22, 2018

(30) Foreign Application Priority Data

Sep. 21, 2016 (JP) ..... 2016-184547

(51) Int. Cl.
*E02F 9/22* (2006.01)

(52) U.S. Cl.
CPC ..... *E02F 9/226* (2013.01); *E02F 9/2228* (2013.01); *F15B 2211/20576* (2013.01); *F15B 2211/30525* (2013.01); *F15B 2211/329* (2013.01); *F15B 2211/40576* (2013.01)

(58) Field of Classification Search
CPC . E02F 3/431; E02F 3/435; E02F 3/437; E02F 9/226; E02F 9/2214; E02F 9/2033; E02F 9/225; B62D 5/075
USPC ..... 60/459
See application file for complete search history.

(56) References Cited

U.S. PATENT DOCUMENTS 5,160,239 A * 11/1992 Allen ..... E02F 3/437 172/4.5
5,178,510 A * 1/1993 Hanamoto ..... E02F 3/437 37/348
5,446,981 A * 9/1995 Kamada ..... E02F 3/437 172/2
5,735,066 A * 4/1998 Tochizawa ..... E02F 3/435 37/348
5,768,810 A * 6/1998 Ahn ..... E02F 3/436 37/348

(Continued)

FOREIGN PATENT DOCUMENTS

CN 103184752 A 7/2013
JP 5-187409 B2 4/2013

*Primary Examiner* — Nathaniel E Wiehe
*Assistant Examiner* — Richard C Drake
(74) *Attorney, Agent, or Firm* — Oliff PLC

(57) ABSTRACT

A hydraulic excavator drive system includes: a control valve for a cylinder that swings a swinging unit; an operation device that outputs an operation signal in accordance with an inclination angle of an operating lever when receiving a first operation of moving the swinging unit closer to a cabin or a second operation of moving the swinging unit farther from the cabin; a solenoid proportional valve connected to a first pilot port of the control valve, the first pilot port being intended for the first operation; and a controller that, when the operation device receives the first operation, controls the solenoid proportional valve such that: a pilot pressure outputted from the solenoid proportional valve is proportional to the operation signal outputted from the operation device until the pilot pressure reaches an upper limit pressure; and the closer the swinging unit to the cabin, the higher the upper limit pressure.

10 Claims, 6 Drawing Sheets

(56) References Cited

U.S. PATENT DOCUMENTS 5,887,365 A * 3/1999 Fujishima ..... E02F 3/437 37/348
7,959,538 B2 * 6/2011 Hatanaka ..... B60T 17/02 180/165
8,145,355 B2 * 3/2012 Danko ..... B25J 9/1607 700/251
8,516,805 B2 * 8/2013 Hagiwara ..... B01D 46/0063 37/348
8,589,038 B2 * 11/2013 Hagiwara ..... E02F 9/226 180/306
9,889,562 B1 * 2/2018 Rembisz ..... B25J 9/1638
2004/0128868 A1 * 7/2004 Helbling ..... E02F 9/2214 37/348
2005/0131610 A1 * 6/2005 Sahm ..... E02F 3/431 701/50
2005/0155258 A1 * 7/2005 Nishimura ..... E02F 3/962 37/403
2007/0033934 A1 * 2/2007 Yamazaki ..... E02F 9/2214 60/459
2009/0151346 A1 * 6/2009 Kim ..... E02F 3/325 60/428
2009/0255750 A1 * 10/2009 Nakamura ..... B62D 5/075 180/422
2011/0150614 A1 * 6/2011 Nicholson ..... E02F 3/431 414/685
2011/0264334 A1 * 10/2011 Murota ..... B66C 3/04 701/50
2013/0047598 A1 * 2/2013 Shimazu ..... E02F 9/2282 60/462
2013/0167522 A1 7/2013 Oguma et al.
2013/0345939 A1 * 12/2013 Magaki ..... E02F 9/2214 701/50
2014/0293051 A1 * 10/2014 Nakamura ..... E02F 9/261 348/148
2015/0147147 A1 * 5/2015 Uchiyama ..... E02F 3/32 414/687
2015/0284930 A1 * 10/2015 Tsukamoto ..... E02F 3/435 701/50
2015/0292184 A1 * 10/2015 Kondo ..... E02F 9/2203 60/463
2015/0368876 A1 * 12/2015 Nakagaki ..... E02F 3/438 701/50
2016/0001701 A1 * 1/2016 Pagliani ..... G01S 13/865 701/36
2019/0284782 A1 * 9/2019 Izumikawa ..... E02F 9/26

* cited by examiner

HYDRAULIC EXCAVATOR DRIVE SYSTEM

BACKGROUND OF THE INVENTION

1. Field of the Invention

The present invention relates to a hydraulic excavator drive system.

2. Description of the Related Art

Generally speaking, a hydraulic excavator includes: a boom that is raised and lowered relative to a turning unit; an arm swingably coupled to the distal end of the boom; and a bucket swingably coupled to the distal end of the arm. A drive system installed in such a hydraulic excavator includes, for example, a boom cylinder that raises and lowers the boom, an arm cylinder that swings the arm, and a bucket cylinder that swings the bucket. These hydraulic actuators are supplied with hydraulic oil from a pump via control valves.

For example, Japanese Laid-Open Patent Application Publication No. H05-187409 discloses a hydraulic excavator drive system 100 shown in FIG. 8. In the drive system 100, the supply and discharge of hydraulic oil to and from an arm cylinder 110 is controlled by a control valve 150. The control valve 150 includes a pair of pilot ports connected to a pilot operation valve 140. The meter-in opening area (the opening area at the meter-in side) and the meter-out opening area (the opening area at the meter-out side) of the control valve 150 increase in accordance with increase in a pilot pressure led to the control valve 150.

In the drive system 100, a supply/discharge line that connects between a rod-side oil chamber 112 of the arm cylinder 110 and the control valve 150 is provided with a pilot open/close valve 120. The pilot open/close valve 120 moves when the pressure in a bottom-side oil chamber 111 of the arm cylinder 110 decreases to a predetermined pressure or lower, thereby reducing the degree of opening of a passage for the hydraulic oil that is discharged from the rod-side oil chamber 112 of the arm cylinder 110. With this configuration, at the time of arm crowding operation, the arm cylinder 110 is prevented from expanding due to the weight of the entire arm and bucket, and cavitation is prevented from occurring in the arm cylinder 110.

SUMMARY OF THE INVENTION

However, the drive system 100 shown in FIG. 8 requires a pressure reducing valve 130 in addition to the pilot open/close valve 120. The pressure reducing valve 130 is a valve for moving the pilot open/close valve 120, and reduces a pilot pressure led from the pilot operation valve 140 to the pilot open/close valve 120 in accordance with the pressure in the bottom-side oil chamber 111 of the arm cylinder 110. Thus, the configuration of the drive system 100 is complex, and the cost thereof is high.

In view of the above, an object of the present invention is to provide a hydraulic excavator drive system that is capable of, with an inexpensive configuration, preventing cavitation due to the influence of gravity from occurring in a cylinder that swings an arm or a bucket.

In order to solve the above-described problems, a hydraulic excavator drive system according to a first aspect of the present invention includes: a cylinder that swings a swinging unit that is an arm or a bucket; a control valve that controls supply and discharge of hydraulic oil to and from the cylinder, the control valve including a first pilot port for a first operation of moving the swinging unit closer to a cabin and a second pilot port for a second operation of moving the swinging unit farther from the cabin; an operation device that includes an operating lever and that outputs an operation signal in accordance with an inclination angle of the operating lever when receiving the first operation or the second operation; a solenoid proportional valve connected to the first pilot port; and a controller that controls the solenoid proportional valve based on the operation signal. The controller, when the operation device receives the first operation, controls the solenoid proportional valve such that: a pilot pressure outputted from the solenoid proportional valve is proportional to the operation signal outputted from the operation device until the pilot pressure reaches an upper limit pressure; and the closer the swinging unit is to the cabin, the higher the upper limit pressure is, so long as, at least, a center of gravity of an entirety of the arm and the bucket in a case where the swinging unit is the arm, or a center of gravity of the bucket in a case where the swinging unit is the bucket, is positioned on an opposite side to the cabin with reference to a vertical line passing through a swinging center of the swinging unit.

According to the above configuration, at the time of first operation, when the center of gravity of a gravity-influenced part, the gravity-influenced part being either the entirety of the arm and the bucket or the bucket alone, is farthest from the cabin, in other words, when gravity is exerted on the swinging unit such that the swinging of the swinging unit is most accelerated, the upper limit pressure of the pilot pressure outputted from the solenoid proportional valve is minimized. That is, the farther the center of gravity of the gravity-influenced part is from the cabin, the smaller is the meter-out maximum opening area of the control valve when the operating lever of the operation device is greatly inclined. This makes it possible to prevent cavitation due to the influence of gravity from occurring in the cylinder when the swinging unit swings with gravity. In addition, such advantage can be achieved with an inexpensive configuration in which the single solenoid proportional valve is used for the first operation.

The controller, when the operation device receives the first operation, may control the solenoid proportional valve such that, over an entire range of swinging of the swinging unit, the closer the swinging unit is to the cabin, the higher the upper limit pressure is. According to this configuration, at the time of first operation, when the center of gravity of the gravity-influenced part is closest to the cabin, in other words, when gravity is exerted on the swinging unit such that the swinging of the swinging unit is most decelerated, the upper limit pressure of the pilot pressure outputted from the solenoid proportional valve is maximized. That is, the closer the center of gravity of the gravity-influenced part is to the cabin, the greater is the meter-out maximum opening area of the control valve when the operating lever of the operation device is greatly inclined. Accordingly, when the swinging unit swings against gravity, the meter-out maximum opening area of the control valve when the operating lever of the operation device is greatly inclined is increased. As a result, throttling by the control valve of the hydraulic oil discharged from the cylinder is suppressed. Therefore, when the center of gravity of the gravity-influenced part is positioned on the same side as the cabin with reference to the vertical line, necessary motive force for swinging the swinging unit can be reduced.

The solenoid proportional valve may be a first solenoid proportional valve. The hydraulic excavator drive system may further include a second solenoid proportional valve connected to the second pilot port. The controller, when the operation device receives the second operation, may control the second solenoid proportional valve such that: a pilot pressure outputted from the second solenoid proportional valve is proportional to the operation signal outputted from the operation device until the pilot pressure reaches an upper limit pressure; and the farther the swinging unit is from the cabin, the higher the upper limit pressure is, so long as, at least, the center of gravity of the entirety of the arm and the bucket in the case where the swinging unit is the arm, or the center of gravity of the bucket in the case where the swinging unit is the bucket, is positioned on a same side as the cabin with reference to the vertical line passing through the swinging center of the swinging unit. According to this configuration, at the time of second operation, when the center of gravity of the gravity-influenced part is closest to the cabin, in other words, when gravity is exerted on the swinging unit such that the swinging of the swinging unit is most accelerated, the upper limit pressure of the pilot pressure outputted from the second solenoid proportional valve is minimized. That is, the closer the center of gravity of the gravity-influenced part is to the cabin, the smaller is the meter-out maximum opening area of the control valve when the operating lever of the operation device is greatly inclined. This makes it possible to prevent cavitation due to the influence of gravity from occurring in the cylinder when the swinging unit swings with gravity. In addition, such advantage can be achieved with an inexpensive configuration in which the single solenoid proportional valve is used for the second operation.

The controller, when the operation device receives the second operation, may control the second solenoid proportional valve such that, over an entire range of swinging of the swinging unit, the farther the swinging unit is from the cabin, the higher the upper limit pressure is. According to this configuration, at the time of second operation, when the center of gravity of the gravity-influenced part is farthest from the cabin, in other words, when gravity is exerted on the swinging unit such that the swinging of the swinging unit is most decelerated, the upper limit pressure of the pilot pressure outputted from the second solenoid proportional valve is maximized. That is, the farther the center of gravity of the gravity-influenced part is from the cabin, the greater is the meter-out maximum opening area of the control valve when the operating lever of the operation device is greatly inclined. Accordingly, when the swinging unit swings against gravity, the meter-out maximum opening area of the control valve when the operating lever of the operation device is greatly inclined is increased. As a result, throttling by the control valve of the hydraulic oil discharged from the cylinder is suppressed. Therefore, when the center of gravity of the gravity-influenced part is positioned on the opposite side to the cabin with reference to the vertical line, necessary motive force for swinging the swinging unit can be reduced.

A hydraulic excavator drive system according to another aspect of the present invention includes: a cylinder that swings a swinging unit that is an arm or a bucket; a control valve that controls supply and discharge of hydraulic oil to and from the cylinder, the control valve including a first pilot port for a first operation of moving the swinging unit closer to a cabin and a second pilot port for a second operation of moving the swinging unit farther from the cabin; an operation device that includes an operating lever and that outputs an operation signal in accordance with an inclination angle of the operating lever when receiving the first operation or the second operation; a solenoid proportional valve connected to the second pilot port; and a controller that controls the solenoid proportional valve based on the operation signal. The controller, when the operation device receives the second operation, controls the solenoid proportional valve such that: a pilot pressure outputted from the solenoid proportional valve is proportional to the operation signal outputted from the operation device until the pilot pressure reaches an upper limit pressure; and the farther the swinging unit is from the cabin, the higher the upper limit pressure is, so long as, at least, a center of gravity of an entirety of the arm and the bucket in a case where the swinging unit is the arm, or a center of gravity of the bucket in a case where the swinging unit is the bucket, is positioned on a same side as the cabin with reference to a vertical line passing through a swinging center of the swinging unit.

According to the above configuration, at the time of second operation, when the center of gravity of the gravity-influenced part is closest to the cabin, in other words, when gravity is exerted on the swinging unit such that the swinging of the swinging unit is most accelerated, the upper limit pressure of the pilot pressure outputted from the solenoid proportional valve is minimized. That is, the closer the center of gravity of the gravity-influenced part is to the cabin, the smaller is the meter-out maximum opening area of the control valve when the operating lever of the operation device is greatly inclined. This makes it possible to prevent cavitation due to the influence of gravity from occurring in the cylinder when the swinging unit swings with gravity. In addition, such advantage can be achieved with an inexpensive configuration in which the single solenoid proportional valve is used for the second operation.

The controller, when the operation device receives the second operation, may control the solenoid proportional valve such that, over an entire range of swinging of the swinging unit, the farther the swinging unit is from the cabin, the higher the upper limit pressure is. According to this configuration, at the time of second operation, when the center of gravity of the gravity-influenced part is farthest from the cabin, in other words, when gravity is exerted on the swinging unit such that the swinging of the swinging unit is most decelerated, the upper limit pressure of the pilot pressure outputted from the solenoid proportional valve is maximized. That is, the farther the center of gravity of the gravity-influenced part is from the cabin, the greater is the meter-out maximum opening area of the control valve when the operating lever of the operation device is greatly inclined. Accordingly, when the swinging unit swings against gravity, the meter-out maximum opening area of the control valve when the operating lever of the operation device is greatly inclined is increased. As a result, throttling by the control valve of the hydraulic oil discharged from the cylinder is suppressed. Therefore, when the center of gravity of the gravity-influenced part is positioned on the opposite side to the cabin with reference to the vertical line, necessary motive force for swinging the swinging unit can be reduced.

The above hydraulic excavator drive system may further include: a turning unit; and a camera that is mounted on the turning unit and that captures an image of the swinging unit. The controller may derive a swing angle from the image captured by the camera, the swing angle being an angle formed between the vertical line and a line that connects the center of gravity and the swinging center of the swinging unit, and determine the upper limit pressure in accordance with the swing angle. It should be noted that a stroke sensor may be provided on each of the boom cylinder and the arm cylinder, or may be provided on each of the boom cylinder, the arm cylinder, and the bucket cylinder, and the swing angle of the swinging unit can be calculated from detection values of these stroke sensors. However, since great vibrations are applied to these cylinders, it is necessary to take countermeasures against the vibrations in a case where such stroke sensors are used. Moreover, in a case where the swinging unit is, for example, the arm, both the stroke detection value of the boom cylinder and the stroke detection value of the arm cylinder are necessary for calculating the swing angle of the arm. On the other hand, by mounting the camera on the turning unit, which is subjected to less vibrations, and deriving the swing angle of the swinging unit from the image captured by the camera, negative influence due to vibrations can be avoided with a simple configuration.

The above hydraulic excavator drive system may further include: a running unit that supports the turning unit such that the turning unit is turnable; and an inclination sensor that is mounted on the turning unit and that detects levelness of the turning unit. The vertical line may be an imaginary straight line parallel to a turning axis of the turning unit. The controller may correct, based on the levelness detected by the inclination sensor, the swing angle derived from the image captured by the camera. This configuration makes it possible to precisely derive the swing angle of the swinging unit regardless of the inclination of the ground surface.

The present invention makes it possible to, with an inexpensive configuration, prevent cavitation due to the influence of gravity from occurring in a cylinder that swings an arm or a bucket.

The above and further objects, features, and advantages of the present invention will more fully be apparent from the following detailed description with accompanying drawings.

DESCRIPTION OF THE PREFERRED EMBODIMENTS

Embodiment 1

Figure 1:
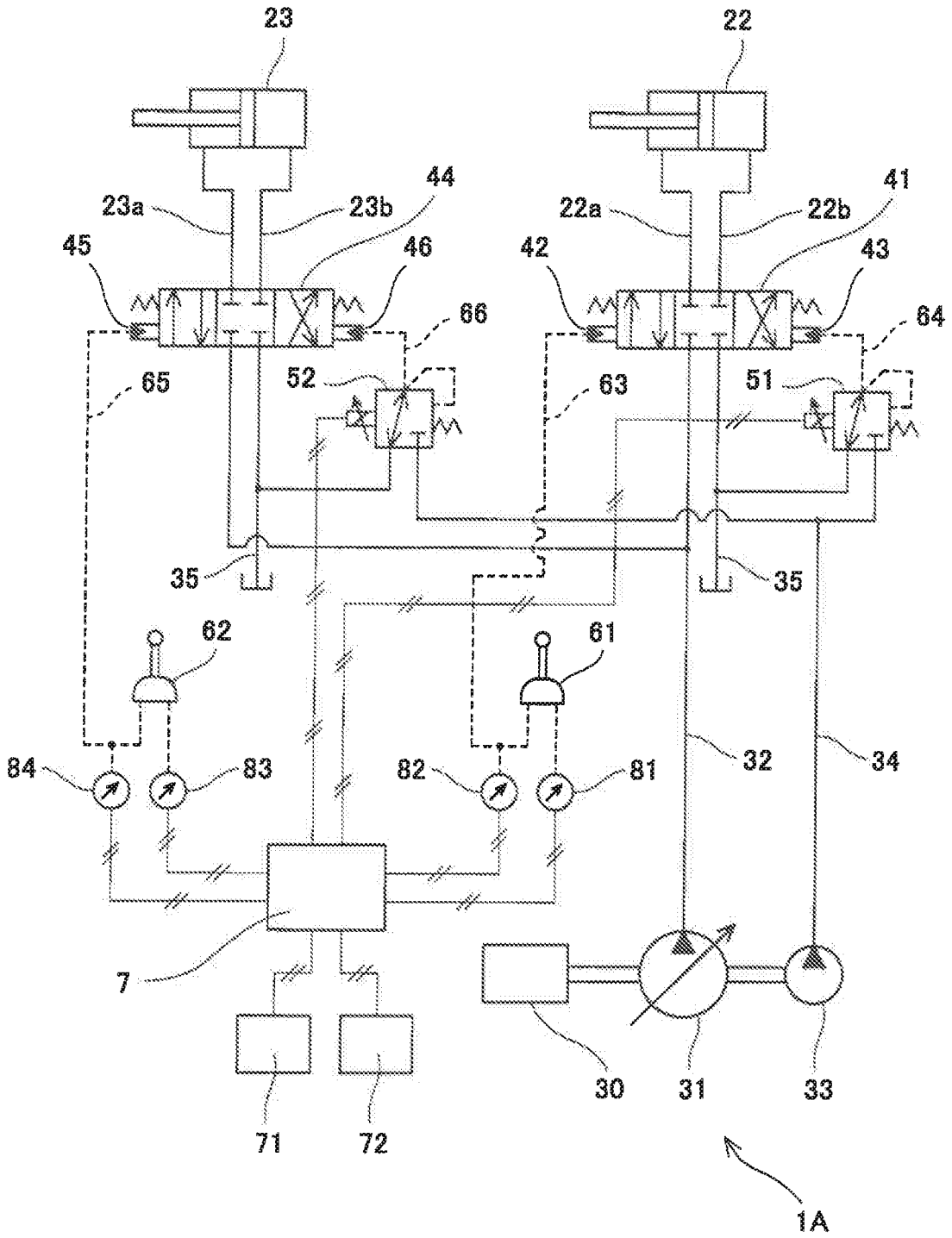
FIG. 1 shows a schematic configuration of a hydraulic excavator drive system according to Embodiment 1 of the present invention.
Figure 2:
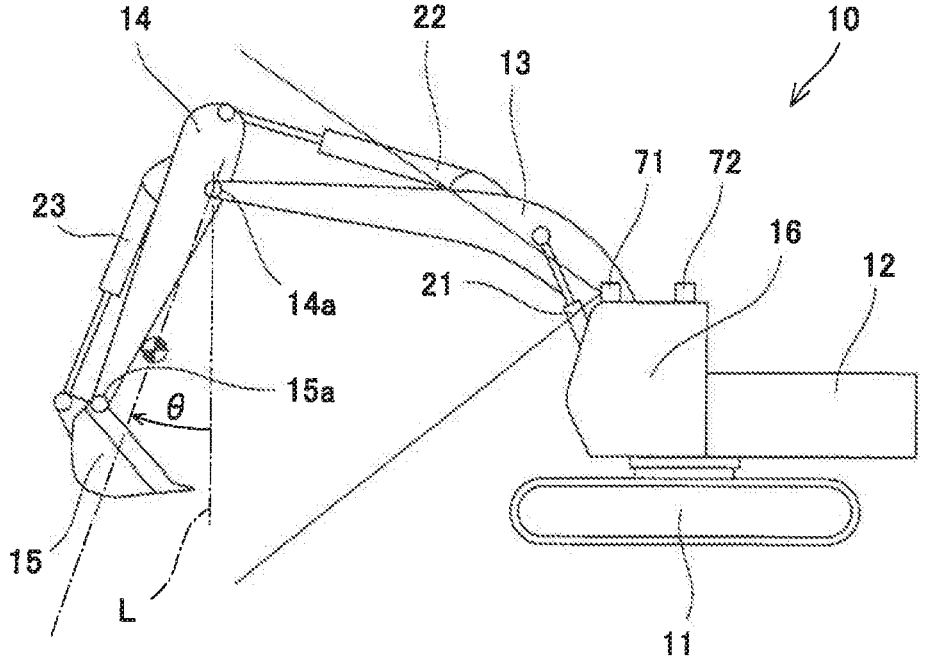
FIG. 2 is a side view of a hydraulic excavator.

FIG. 1 shows a hydraulic excavator drive system 1A according to Embodiment 1 of the present invention. FIG. 2 shows a hydraulic excavator 10, in which the drive system 1A is installed.

The hydraulic excavator 10 shown in FIG. 2 is a self-propelled excavator, and includes a running unit 11. The hydraulic excavator 10 further includes: a turning unit 12 turnably supported by the running unit 11; and a boom 13, which is raised and lowered relative to the turning unit 12. An arm 14 is swingably coupled to the distal end of the boom 13, and a bucket 15 is swingably coupled to the distal end of the arm 14. The turning unit 12 includes a cabin 16, in which an operator's seat is set.

As shown in FIG. 1, the drive system 1A includes, as hydraulic actuators, a pair of right and left running motors and a turning motor (which are not shown), a boom cylinder 21 (see FIG. 2), an arm cylinder 22, and a bucket cylinder 23. The boom cylinder 21 raises and lowers the boom 13. The arm cylinder 22 swings the arm 14. The bucket cylinder 23 swings the bucket 15.

The above hydraulic actuators are supplied with hydraulic oil from a main pump 31 via control valves. The main pump 31 is driven by an engine 30. For example, the arm cylinder 22 is supplied with the hydraulic oil via an arm control valve 41, and the bucket cylinder 23 is supplied with the hydraulic oil via a bucket control valve 44. It should be noted that control valves for the other hydraulic actuators are not shown in FIG. 1. The main pump 31 may be either a single pump or a double pump.

Specifically, the arm control valve 41 and the bucket control valve 44 are connected to the main pump 31 by a supply line 32. Each of the arm control valve 41 and the bucket control valve 44 is connected to a tank by a tank line 35.

The arm control valve 41 is connected to the arm cylinder 22 by a pair of supply/discharge lines 22*a* and 22*b*. The arm control valve 41 controls the supply and discharge of the hydraulic oil to and from the arm cylinder 22. The arm control valve 41 includes: a first pilot port 43 for an arm crowding operation of moving the arm 14 closer to the cabin 16; and a second pilot port 42 for an arm pushing operation of moving the arm 14 farther from the cabin 16.

Similarly, the bucket control valve 44 is connected to the bucket cylinder 23 by a pair of supply/discharge lines 23*a* and 23*b*. The bucket control valve 44 controls the supply and discharge of the hydraulic oil to and from the bucket cylinder 23. The bucket control valve 44 includes: a first pilot port 46 for a bucket-in operation of moving the bucket 15 closer to the cabin 16; and a second pilot port 45 for a bucket-out operation of moving the bucket 15 farther from the cabin 16.

The drive system 1A further includes: an arm operation device 61 for moving the arm control valve 41; and a bucket operation device 62 for moving the bucket control valve 44. The arm operation device 61 includes an operating lever, and outputs an operation signal in accordance with the inclination angle of the operating lever when receiving the arm crowding operation or the arm pushing operation. The bucket operation device 62 includes an operating lever, and outputs an operation signal in accordance with the inclination angle of the operating lever when receiving the bucket-in operation or the bucket-out operation.

In the present embodiment, each of the arm operation device 61 and the bucket operation device 62 is a pilot operation valve that outputs a pilot pressure as an operation signal. The pilot pressure that the arm operation device 61 outputs when receiving the arm crowding operation (i.e., when the operating lever is inclined in an arm crowding direction) is detected by a first pressure meter 81. The pilot pressure that the arm operation device 61 outputs when receiving the arm pushing operation (i.e., when the operating lever is inclined in an arm pushing direction) is detected by a second pressure meter 82. Similarly, the pilot pressure that the bucket operation device 62 outputs when receiving the bucket-in operation (i.e., when the operating lever is inclined in a bucket-in direction) is detected by a third pressure meter 83. The pilot pressure that the bucket operation device 62 outputs when receiving the bucket-out operation (i.e., when the operating lever is inclined in a bucket-out direction) is detected by a fourth pressure meter 84. These pilot pressures detected by the first to fourth pressure meters 81 to 84 are inputted to a controller 7.

The aforementioned second pilot port 42 of the arm control valve 41 is connected to the arm operation device 61 by an arm pushing pilot line 63. Meanwhile, the first pilot port 43 is connected to an arm solenoid proportional valve 51 by an arm crowding pilot line 64.

Similarly, the second pilot port 45 of the bucket control valve 44 is connected to the bucket operation device 62 by a bucket-out pilot line 65. Meanwhile, the first pilot port 46 is connected to a bucket solenoid proportional valve 52 by a bucket-in pilot line 66.

The arm solenoid proportional valve 51 and the bucket solenoid proportional valve 52 are connected to an auxiliary pump 33 by a primary pressure line 34. Similar to the main pump 31, the auxiliary pump 33 is driven by the engine 30.

The aforementioned controller 7 is, for example, a computer that includes memories such as a ROM and RAM and a CPU. The CPU executes a program stored in the ROM. At the time of arm crowding operation, the controller 7 controls the arm solenoid proportional valve 51 based on an operation signal outputted from the arm operation device 61 (in the present embodiment, based on a pilot pressure detected by the first pressure meter 81). At the time of bucket-in operation, the controller 7 controls the bucket solenoid proportional valve 52 based on an operation signal outputted from the bucket operation device 62 (in the present embodiment, based on a pilot pressure detected by the third pressure meter 83).

In the present embodiment, each of the solenoid proportional valves 51 and 52 is a direct proportional valve outputting a pilot pressure (secondary pressure) that indicates a positive correlation with a command current. However, as an alternative, each of the solenoid proportional valves 51 and 52 may be an inverse proportional valve outputting a pilot pressure that indicates a negative correlation with a command current.

Specifically, the controller 7 feeds a command current to the arm solenoid proportional valve 51 at the time of arm crowding operation, and feeds a command current to the bucket solenoid proportional valve 52 at the time of bucket-in operation. At the time of arm pushing operation, since the pilot pressure outputted from the arm operation device 61 is led to the second pilot port 42 of the arm control valve 41, the arm control valve 41 is controlled in accordance with the inclination angle of the operating lever of the arm operation device 61. Similarly, at the time of bucket-out operation, since the pilot pressure outputted from the bucket operation device 62 is led to the second pilot port 45 of the bucket control valve 44, the bucket control valve 44 is controlled in accordance with the inclination angle of the operating lever of the bucket operation device 62.

At the time of bucket-in operation, the controller 7 controls the bucket solenoid proportional valve 52, such that the pilot pressure outputted from the bucket solenoid proportional valve 52 is proportional to the operation signal outputted from the bucket operation device 62. That is, the controller 7 feeds the bucket solenoid proportional valve 52 with a command current proportional to the operation signal outputted from the bucket operation device 62.

In the present embodiment, at the time of arm crowding operation, control based on an upper limit pressure PL, which will be described below, is performed. Specifically, in the present embodiment, the arm 14 corresponds to a swinging unit of the present invention, and the arm crowding operation and the arm pushing operation correspond to a first operation and a second operation of the present invention, respectively.

Figure 4:
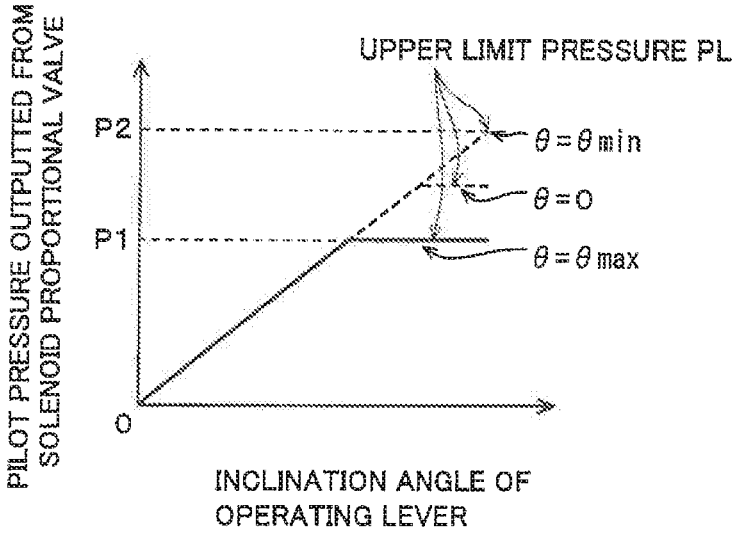
FIG. 4 is a graph showing a relationship between the inclination angle of an operating lever and a pilot pressure outputted from a solenoid proportional valve.

At the time of arm crowding operation, as shown in FIG. 4, the controller 7 controls the arm solenoid proportional valve 51, such that the pilot pressure outputted from the arm solenoid proportional valve 51 is proportional to the operation signal outputted from the arm operation device 61 until the pilot pressure reaches the upper limit pressure PL. Specifically, the controller 7 feeds the arm solenoid proportional valve 51 with a command current that is proportional to the operation signal outputted from the arm operation device 61 until the pilot pressure outputted from the arm solenoid proportional valve 51 reaches the upper limit pressure PL. Thereafter, even if the operating lever of the arm operation device 61 is further inclined, the command current fed to the arm solenoid proportional valve 51 is kept to a value corresponding to the upper limit pressure PL.

The controller 7 further controls the arm solenoid proportional valve 51, such that the closer the arm 14 is to the cabin 16, the higher the upper limit pressure PL is. In the present embodiment, such control is performed over the entire range of swinging of the arm 14.

As shown in FIG. 2, in the present embodiment, a camera 71 is mounted on the cabin 16 of the turning unit 12. The camera 71 captures an image of the arm 14. The controller 7 derives a swing angle θ of the arm 14 from the image captured by the camera 71. The swing angle θ of the arm 14 is an angle formed between: a line that connects the center of gravity of a gravity-influenced part, the gravity-influenced part being the entirety of the arm 14 and the bucket 15, and a swinging center 14*a* of the arm 14; and a vertical line L passing through the swinging center 14*a*. The center of gravity of the gravity-influenced part may be a predetermined point, or may be a point that varies depending on the orientation of the bucket 15.

Specifically, the controller 7 calculates the swing angle θ of the arm 14 by comparing the image captured by the camera 71 with prestored reference data. In this case, regardless of the levelness of the turning unit 12, the vertical line L passing through the swinging center 14*a* of the arm 14 is an imaginary straight line parallel to the turning axis of the turning unit 12. After deriving the swing angle θ of the arm 14, the controller 7 determines the upper limit pressure PL in accordance with the swing angle θ.

The swing angle θ of the arm 14 is zero when the center of gravity of the gravity-influenced part is on the vertical line L. At the time of arm crowding operation, the swing angle θ is a plus angle when the center of gravity is positioned farther from the cabin 16 than the vertical line L, and the swing angle θ is a minus angle when the center of gravity is positioned closer to the cabin 16 than the vertical line L.

Figure 3:
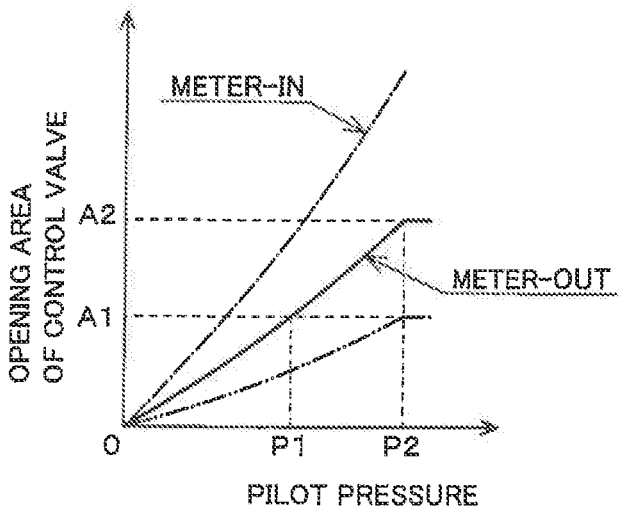
FIG. 3 is a graph showing a relationship between a pilot pressure to a control valve and the opening area of the control valve.
Figure 5:
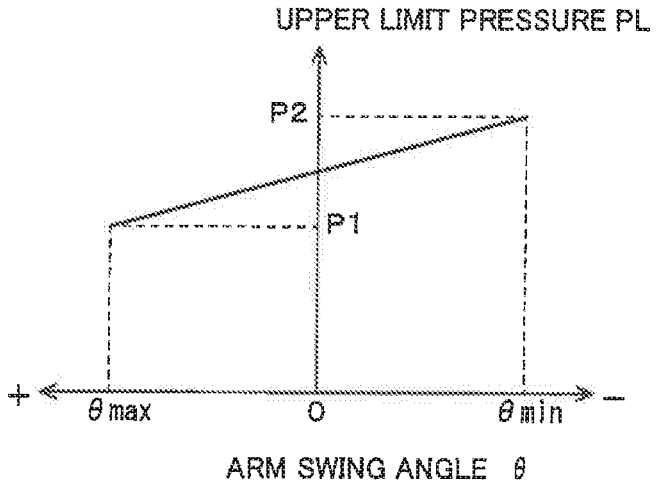
FIG. 5 is a graph showing a relationship between the swing angle of an arm and the upper limit pressure of the pilot pressure outputted from the solenoid proportional valve.

In the present embodiment, as shown in FIG. 5, when the arm 14 swings from its farthest position from the cabin 16 to its closest position to the cabin 16, in other words, when the swing angle θ of the arm 14 decreases from a maximum angle θ max (a plus angle) to a minimum angle θ min (a minus angle), the upper limit pressure PL increases from P1 to P2. Accordingly, as shown in FIG. 4, the maximum pilot pressure when the operating lever of the arm operation device 61 is fully inclined changes within a range between P1 and P2 in accordance with the swing angle θ of the arm 14. Therefore, as shown in FIG. 3, the meter-out maximum opening area of the arm control valve 41 when the operating lever of the arm operation device 61 is greatly inclined is set to a small value of A1 when the swing angle θ of the arm 14 is the maximum angle θ max, and the meter-out maximum opening area of the arm control valve 41 when the operating lever of the arm operation device 61 is greatly inclined is set to a large value of A2 when the swing angle θ of the arm 14 is the minimum angle θ min.

Figure 6:
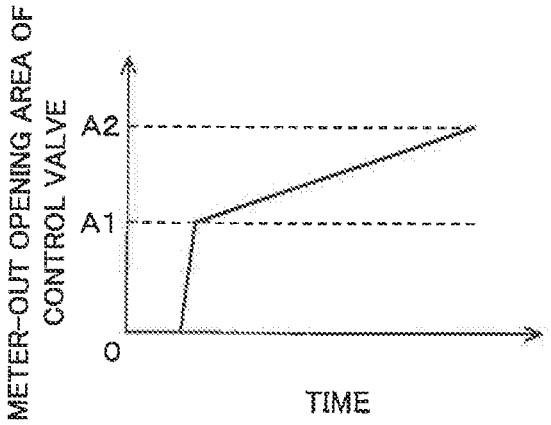
FIG. 6 is a graph showing temporal changes in the meter-out opening area of the control valve when the arm is swung from its farthest position from a cabin to its closest position to the cabin by greatly inclining the operating lever.

For example, in a state where the swing angle θ of the arm 14 is the maximum angle θ max, if the operating lever of the arm operation device 61 is fully inclined until the swing angle θ of the arm 14 becomes the minimum angle θ min, the meter-out opening area of the arm control valve 41 first increases rapidly to A1, and thereafter increases gradually to A2 in accordance with changes in the swing angle θ, as shown in FIG. 6.

Further, in the present embodiment, an inclination sensor 72 is mounted on the turning unit 12 as shown in FIG. 2. In the example illustrated in FIG. 2, the inclination sensor 72 is disposed on the cabin 16. However, as an alternative, the inclination sensor 72 may be disposed at a different position (e.g., disposed on the engine room). The inclination sensor 72 detects the levelness of the turning unit 12. Based on the levelness detected by the inclination sensor 72, the controller 7 corrects the swing angle θ of the arm 14, which is derived from the image captured by the camera 71. For example, when the turning unit 12 is inclined such that its front side is lower than the rear side, the swing angle θ of the arm 14, which is derived from the image captured by the camera 71, is corrected by subtracting the inclination angle of the turning unit 12 (i.e., the levelness detected by the inclination sensor 72) from the swing angle θ.

As described above, in the drive system 1A of the present embodiment, at the time of arm crowding operation, when the center of gravity of the gravity-influenced part (the entirety of the arm 14 and the bucket 15) is farthest from the cabin 16, in other words, when gravity is exerted on the arm 14 such that the swinging of the arm 14 is most accelerated, the upper limit pressure PL of the pilot pressure outputted from the arm solenoid proportional valve 51 is P1, which is the minimum upper limit pressure. That is, the farther the center of gravity of the gravity-influenced part is from the cabin 16 (i.e., the greater the swing angle θ of the arm 14), the smaller is the meter-out maximum opening area of the arm control valve 41 when the operating lever of the arm operation device 61 is greatly inclined. This makes it possible to prevent cavitation due to the influence of gravity from occurring in the arm cylinder 22 when the arm 14 swings with gravity. In addition, such advantage can be achieved with an inexpensive configuration in which the single arm solenoid proportional valve 51 is used for the arm crowding operation.

On the other hand, when the center of gravity of the gravity-influenced part is closest to the cabin 16 at the time of arm crowding operation, in other words, when gravity is exerted on the arm 14 such that the swinging of the arm 14 is most decelerated, the upper limit pressure PL of the pilot pressure outputted from the arm solenoid proportional valve 51 is P2, which is the maximum upper limit pressure. That is, the closer the center of gravity of the gravity-influenced part is to the cabin 16 (i.e., the smaller the swing angle θ of the arm 14), the greater is the meter-out maximum opening area of the arm control valve 41 when the operating lever of the arm operation device 61 is greatly inclined. Accordingly, when the arm 14 swings against gravity, the meter-out maximum opening area of the arm control valve 41 when the operating lever of the arm operation device 61 is greatly inclined is increased. As a result, throttling by the arm control valve 41 of the hydraulic oil discharged from the arm cylinder 22 is suppressed. Therefore, when the center of gravity of the gravity-influenced part is positioned on the same side as the cabin 16 with reference to the vertical line L, necessary motive force for swinging the arm 14 can be reduced.

Hereinafter, a case where the control based on the upper limit pressure PL is not performed is described. In this case, as indicated by a two-dot chain line in FIG. 3, the meter-out opening area of the arm control valve 41 needs to be reduced compared to the meter-out opening area of the present embodiment (indicated by a solid line in FIG. 3). The reason for this is that the meter-out maximum opening area of the arm control valve 41 in the case where the control based on the upper limit pressure PL is not performed is set such that cavitation will not occur in the arm cylinder 22 under the worst conditions (where the swing angle θ of the arm 14 is the maximum angle θ max, and the operating lever of the arm operation device 61 is fully inclined). Therefore, under non-worst conditions, the hydraulic oil discharged from the arm cylinder 22 is wastefully throttled by the arm control valve 41.

On the other hand, in the present embodiment, the meter-out maximum opening area of the arm control valve 41 when the operating lever of the arm operation device 61 is greatly inclined changes in accordance with the swing angle θ of the arm 14. Therefore, the meter-out opening area of the arm control valve 41 can be significantly increased compared to the meter-out opening area of the arm control valve 41 in the case where the control based on the upper limit pressure PL is not performed.

It should be noted that a stroke sensor may be provided on each of the boom cylinder 21 and the arm cylinder 22, and the swing angle θ of the arm 14 can be calculated from detection values of these stroke sensors. However, since great vibrations are applied to the boom cylinder 21 and the arm cylinder 22, it is necessary to take countermeasures against the vibrations in a case where such stroke sensors are used. Moreover, in this case, both the stroke detection value of the boom cylinder 21 and the stroke detection value of the arm cylinder 22 are necessary for calculating the swing angle θ of the arm 14. On the other hand, by mounting the camera 71 on the turning unit 12, which is subjected to less vibrations, and deriving the swing angle θ of the arm 14 from the image captured by the camera 71 as in the present embodiment, negative influence due to vibrations can be avoided with a simple configuration.

Furthermore, in the present embodiment, the swing angle θ of the arm 14 derived from the image captured by the camera 71 is corrected based on the levelness of the turning unit 12 detected by the inclination sensor 72. This makes it possible to precisely derive the swing angle θ of the arm 14 regardless of the inclination of the ground surface.

<Variations>

The bucket solenoid proportional valve 52 may be eliminated, and the bucket operation device 62, which is a pilot operation valve, may be connected to the first pilot port 46 of the bucket control valve 44 by the bucket-in pilot line 66. However, the presence of the bucket solenoid proportional valve 52 makes it possible to perform the control based on the upper limit pressure PL even at the time of bucket-in operation. Alternatively, the control based on the upper limit pressure PL may be performed not at the time of arm crowding operation, but only at the time of bucket-in operation. In this case, the arm solenoid proportional valve 51 may be eliminated, and the arm operation device 61, which is a pilot operation valve, may be connected to the first pilot port 43 of the arm control valve 41 by the arm crowding pilot line 64.

In a case where the control based on the upper limit pressure PL is performed at the time of bucket-in operation, the bucket 15 corresponds to the swinging unit of the present invention, and the bucket-in operation and the bucket-out operation correspond to the first operation and the second operation of the present invention, respectively. In this case, similar to the above-described embodiment, the controller 7 controls the bucket solenoid proportional valve 52, such that the pilot pressure outputted from the bucket solenoid proportional valve 52 is proportional to the operation signal outputted from the bucket operation device 62 until the pilot pressure reaches the upper limit pressure PL. Specifically, the controller 7 feeds the bucket solenoid proportional valve 52 with a command current that is proportional to the operation signal outputted from the bucket operation device 62 until the pilot pressure outputted from the bucket solenoid proportional valve 52 reaches the upper limit pressure PL. Thereafter, even if the operating lever of the bucket operation device 62 is further inclined, the command current fed to the bucket solenoid proportional valve 52 is kept to a value corresponding to the upper limit pressure PL.

The controller 7 further controls the bucket solenoid proportional valve 52 over the entire range of swinging of the bucket 15, such that the closer the bucket 15 is to the cabin 16, the higher the upper limit pressure PL is. In this case, an image of the bucket 15 may be captured by the camera 71 mounted on the cabin 16. Then, from the image captured by the camera 71, the controller 7 derives the swing angle of the bucket 15, which is an angle formed between: a line that connects the center of gravity of the bucket 15 (the gravity-influenced part) and a swinging center 15*a* (see FIG. 2) of the bucket 15; and a vertical line passing through the swinging center 15*a*. The controller 7 determines the upper limit pressure PL in accordance with the swing angle.

With the above configuration, the same advantageous effects as those described in the foregoing embodiment can be obtained (for details, replace the arm 14 with the bucket 15 in the foregoing description of the advantageous effects of the embodiment).

In the foregoing embodiment, over the entire range of swinging of the arm 14, the closer the arm 14 is to the cabin 16, the higher the upper limit pressure PL is. However, as an alternative, the upper limit pressure PL may be such that the closer the arm 14 is to the cabin 16, the higher the upper limit pressure PL is, so long as, at least, the center of gravity of the gravity-influenced part (the entirety of the arm 14 and the bucket 15) is positioned on the opposite side to the cabin 16 with reference to the vertical line L. The same is true in the case where the control based on the upper limit pressure PL is performed at the time of bucket-in operation.

Embodiment 2

Figure 7:
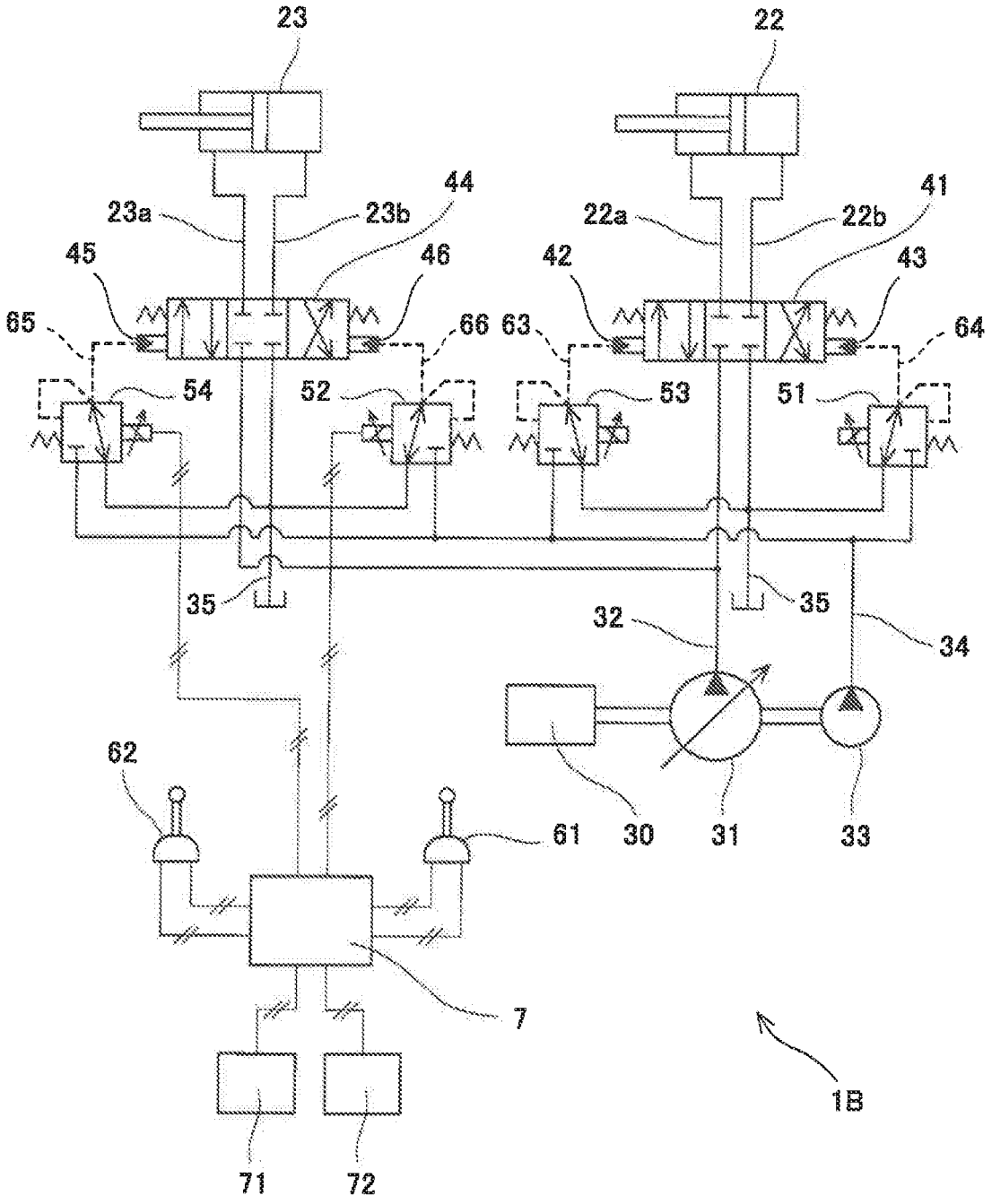
FIG. 7 shows a schematic configuration of a hydraulic excavator drive system according to Embodiment 2 of the present invention.
Figure 8:
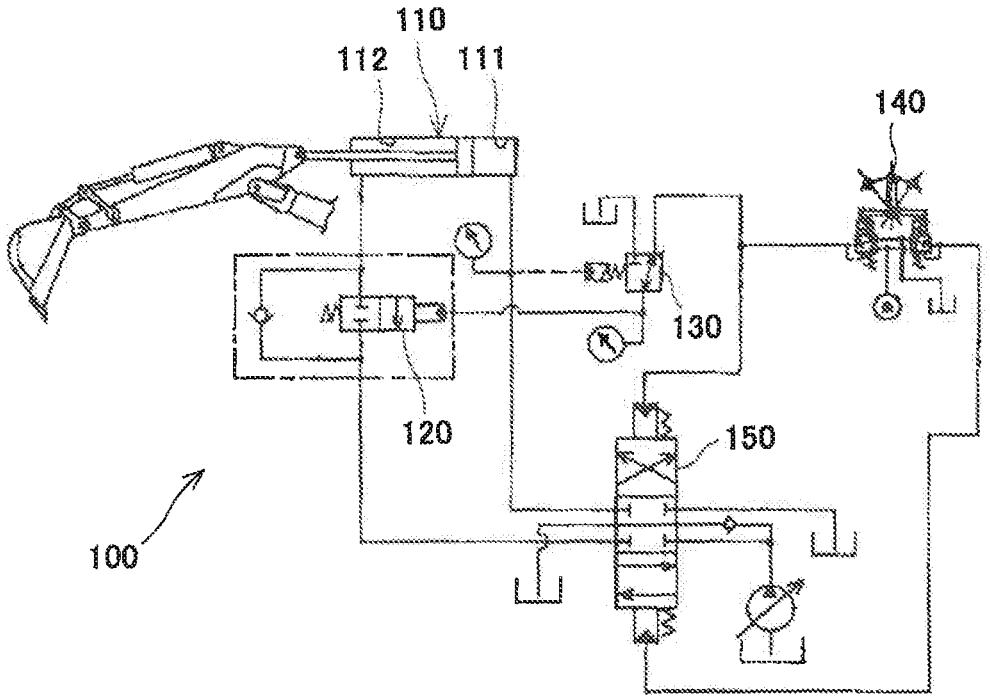
FIG. 8 shows a schematic configuration of a conventional hydraulic excavator drive system.

Next, a hydraulic excavator drive system 1B according to Embodiment 2 of the present invention is described with reference to FIG. 7.

In the present embodiment, each of the arm operation device 61 and the bucket operation device 62 is an electrical joystick that outputs an electrical signal to the controller 7 as an operation signal. For this reason, the second pilot port 42 of the arm control valve 41 is connected to an arm solenoid proportional valve 53 by the arm pushing pilot line 63, and the second pilot port 45 of the bucket control valve 44 is connected to a bucket solenoid proportional valve 54 by the bucket-out pilot line 65. It should be noted that FIG. 7 shows only part of signal lines for simplifying the drawing.

In the present embodiment, the control based on the upper limit pressure PL, which is described in Embodiment 1, may be performed only at the time of arm crowding operation or only at the time of bucket-in operation. Alternatively, in the present embodiment, the control based on the upper limit pressure PL, which is described in Embodiment 1, may be performed only at the time of arm pushing operation or only at the time of bucket-out operation.

Further, the control based on the upper limit pressure PL may be performed at the time of arm crowding operation and at the time of arm pushing operation. In this case, the arm solenoid proportional valve 51 corresponds to a first solenoid proportional valve of the present invention, and the arm solenoid proportional valve 53 corresponds to a second solenoid proportional valve of the present invention. Alternatively, the control based on the upper limit pressure PL may be performed at the time of bucket-in operation and at the time of bucket-out operation.

For example, in the case of performing the control based on the upper limit pressure PL at the time of arm pushing operation, the controller 7 controls the arm solenoid proportional valve 53, such that a pilot pressure outputted from the arm solenoid proportional valve 53 is proportional to the operation signal outputted from the arm operation device 61 until the pilot pressure reaches the upper limit pressure PL. Moreover, at the time of arm pushing operation, the controller 7 may control the arm solenoid proportional valve 53, such that the farther the arm 14 is from the cabin 16, the higher the upper limit pressure PL is, so long as, at least, the center of gravity of the gravity-influenced part (the entirety of the arm 14 and the bucket 15) is positioned on the same side as the cabin 16 with reference to the vertical line L. The upper limit pressure PL is determined in the same manner as that described in Embodiment 1.

The swing angle θ of the arm 14 is zero when the center of gravity of the gravity-influenced part is on the vertical line L. At the time of arm pushing operation, the swing angle θ is a plus angle when the center of gravity is positioned closer to the cabin 16 than the vertical line L, and the swing angle θ is a minus angle when the center of gravity is positioned farther from the cabin 16 than the vertical line L.

According to the above configuration, at the time of arm pushing operation, the closer the center of gravity of the gravity-influenced part is to the cabin 16 (i.e., the greater the swing angle θ of the arm 14), the smaller is the meter-out maximum opening area of the arm control valve 41 when the operating lever of the arm operation device 61 is greatly inclined. This makes it possible to prevent cavitation due to the influence of gravity from occurring in the arm cylinder 22 when the arm 14 swings with gravity. In addition, such advantage can be achieved with an inexpensive configuration in which the single arm solenoid proportional valve 53 is used for the arm pushing operation.

Moreover, assume a case where the farther the arm 14 is from the cabin 16, the higher the upper limit pressure PL is over the entire range of swinging of the arm 14. In this case, the farther the center of gravity of the gravity-influenced part is from the cabin 16 (i.e., the smaller the swing angle θ of the arm 14), the greater is the meter-out maximum opening area of the arm control valve 41 when the operating lever of the arm operation device 61 is greatly inclined. Accordingly, when the arm 14 swings against gravity, the meter-out maximum opening area of the arm control valve 41 when the operating lever of the arm operation device 61 is greatly inclined is increased. As a result, throttling by the arm control valve 41 of the hydraulic oil discharged from the arm cylinder 22 is suppressed. Therefore, when the center of gravity of the gravity-influenced part is positioned on the opposite side to the cabin 16 with reference to the vertical line L, necessary motive force for swinging the arm 14 can be reduced.

Other Embodiments

The present invention is not limited to the above-described Embodiments 1 and 2. Various modifications can be made without departing from the spirit of the present invention.

For example, each of the arm control valve 41 and the bucket control valve 44 need not be a single control valve, but may include separate control valves that are a meter-in control valve and a meter-out control valve. Also, instead of the engine 30, an electric motor may be used.

The hydraulic excavator 10, in which the drive system (1A or 1B) is installed, need not be a self-propelled excavator. For example, in a case where the hydraulic excavator 10 is mounted on a ship, the turning unit 12 may be turnably supported by the hull.

From the foregoing description, numerous modifications and other embodiments of the present invention are obvious to a person skilled in the art. Therefore, the foregoing description should be interpreted only as an example and is provided for the purpose of teaching the best mode for carrying out the present invention to a person skilled in the art. The structural and/or functional details may be substantially altered without departing from the spirit of the present invention.

REFERENCE SIGNS LIST

1A, 1B hydraulic excavator drive system
10 hydraulic excavator
11 running unit
12 turning unit
14 arm (swinging unit)
15 bucket (swinging unit)
22 arm cylinder
23 bucket cylinder
41 arm control valve
42 second pilot port
43 first pilot port
44 bucket control valve
45 second pilot port
46 first pilot port
51, 52, 53, 54 solenoid proportional valve
61 arm operation device
62 bucket operation device
7 controller
71 camera
72 inclination sensor

What is claimed is:

1. A hydraulic excavator drive system comprising:

a cylinder that swings a swinging unit that is an arm or a bucket;

a control valve that controls supply and discharge of hydraulic oil to and from the cylinder, the control valve including a first pilot port for a first operation of moving the swinging unit closer to a cabin and a second pilot port for a second operation of moving the swinging unit farther from the cabin;

an operation device that includes an operating lever and that outputs an operation signal in accordance with an inclination angle of the operating lever when receiving the first operation or the second operation;

a solenoid proportional valve connected to the first pilot port; and a controller that controls the solenoid proportional valve based on the operation signal, wherein the controller, when the operation device receives the first operation, controls the solenoid proportional valve such that:

a pilot pressure outputted from the solenoid proportional valve is proportional to the operation signal outputted from the operation device until the pilot pressure reaches an upper limit pressure;

the upper limit pressure is modified based on a position of the center of gravity of an entirety of the arm and the bucket relative to a vertical line passing through a swinging center of the swinging unit in the case where the swinging unit is the arm, or based on a position of a center of gravity of the bucket relative to the vertical line in a case where the swinging unit is the bucket; and the upper limit pressure is increased as the swinging unit moved closer to the cabin, so long as, at least, the center of gravity of the entirety of the arm and the bucket in a case where the swinging unit is the arm, or a center of gravity of the bucket in a case where the swinging unit is the bucket, is positioned on an opposite side of the vertical line with reference to the cabin.

2. The hydraulic excavator drive system according to claim 1, wherein the controller, when the operation device receives the first operation, controls the solenoid proportional valve such that, over an entire range of swinging of the swinging unit, the closer the swinging unit is to the cabin, the higher the upper limit pressure is.

3. The hydraulic excavator drive system according to claim 1, wherein the solenoid proportional valve is a first solenoid proportional valve, the hydraulic excavator drive system further comprises a second solenoid proportional valve connected to the second pilot port, and the controller, when the operation device receives the second operation, controls the second solenoid proportional valve such that:

a pilot pressure outputted from the second solenoid proportional valve is proportional to the operation signal outputted from the operation device until the pilot pressure reaches an upper limit pressure; and the farther the swinging unit is from the cabin, the higher the upper limit pressure is, so long as, at least, the center of gravity of the entirety of the arm and the bucket in the case where the swinging unit is the arm, or the center of gravity of the bucket in the case where the swinging unit is the bucket, is positioned on a same side as the cabin with reference to the vertical line passing through the swinging center of the swinging unit.

4. The hydraulic excavator drive system according to claim 3, wherein the controller, when the operation device receives the second operation, controls the second solenoid proportional valve such that, over an entire range of swinging of the swinging unit, the farther the swinging unit is from the cabin, the higher the upper limit pressure is.

5. The hydraulic excavator drive system according to claim 1, further comprising:

a turning unit; and a camera that is mounted on the turning unit and that captures an image of the swinging unit, wherein the controller derives a swing angle from the image captured by the camera, the swing angle being an angle formed between the vertical line and a line that connects the center of gravity and the swinging center of the swinging unit, and determines the upper limit pressure in accordance with the swing angle.

6. The hydraulic excavator drive system according to claim 5, further comprising:

a running unit that supports the turning unit such that the turning unit is turnable; and an inclination sensor that is mounted on the turning unit and that detects levelness of the turning unit, wherein the vertical line is an imaginary straight line parallel to a turning axis of the turning unit, and the controller corrects, based on the levelness detected by the inclination sensor, the swing angle derived from the image captured by the camera.

7. A hydraulic excavator drive system comprising:

a cylinder that swings a swinging unit that is an arm or a bucket;

a control valve that controls supply and discharge of hydraulic oil to and from the cylinder, the control valve including a first pilot port for a first operation of moving the swinging unit closer to a cabin and a second pilot port for a second operation of moving the swinging unit farther from the cabin;

an operation device that includes an operating lever and that outputs an operation signal in accordance with an inclination angle of the operating lever when receiving the first operation or the second operation;

a solenoid proportional valve connected to the second pilot port; and a controller that controls the solenoid proportional valve based on the operation signal, wherein the controller, when the operation device receives the second operation, controls the solenoid proportional valve such that:

a pilot pressure outputted from the solenoid proportional valve is proportional to the operation signal outputted from the operation device until the pilot pressure reaches an upper limit pressure; and the farther the swinging unit is from the cabin, the higher the upper limit pressure is, so long as, at least, a center of gravity of an entirety of the arm and the bucket in a case where the swinging unit is the arm, or a center of gravity of the bucket in a case where the swinging unit is the bucket, is positioned on a same side as the cabin with reference to a vertical line passing through a swinging center of the swinging unit.

8. The hydraulic excavator drive system according to claim 7, wherein the controller, when the operation device receives the second operation, controls the solenoid proportional valve such that, over an entire range of swinging of the swinging unit, the farther the swinging unit is from the cabin, the higher the upper limit pressure is.

9. The hydraulic excavator drive system according to claim 7, further comprising:

a turning unit; and a camera that is mounted on the turning unit and that captures an image of the swinging unit, wherein the controller derives a swing angle from the image captured by the camera, the swing angle being an angle formed between the vertical line and a line that connects the center of gravity and the swinging center of the swinging unit, and determines the upper limit pressure in accordance with the swing angle.

10. The hydraulic excavator drive system according to claim 9, further comprising:

a running unit that supports the turning unit such that the turning unit is turnable; and an inclination sensor that is mounted on the turning unit and that detects levelness of the turning unit, wherein the vertical line is an imaginary straight line parallel to a turning axis of the turning unit, and the controller corrects, based on the levelness detected by the inclination sensor, the swing angle derived from the image captured by the camera.

* * * * *